United States Patent [19]

Helmes et al.

[11] Patent Number: 4,888,850

[45] Date of Patent: Dec. 26, 1989

[54] VACUUM CLEANER NOZZLE ARRANGEMENT

[75] Inventors: Ludger Helmes, Velbert; Paul Lienenlüke, Sprockhövel, both of Fed. Rep. of Germany

[73] Assignee: Vorwerk & Co. Interholding GmbH, Wuppertal, Fed. Rep. of Germany

[21] Appl. No.: 55,552

[22] Filed: May 29, 1987

[30] Foreign Application Priority Data

Jun. 4, 1986 [DE] Fed. Rep. of Germany ..... 3618803

[51] Int. Cl.[4] ..... A47L 9/02

[52] U.S. Cl. ..... 15/359; 15/371

[58] Field of Search ..... 15/358, 359, 360, 371, 15/354, 1.7; 138/121

[56] References Cited

U.S. PATENT DOCUMENTS

| | | | |
|---|---|---|---|
| 2,938,225 | 5/1960 | Carabet | 15/359 |
| 3,039,129 | 6/1962 | Belicka et al. | 15/359 |
| 3,234,969 | 2/1966 | Du Mont | 138/121 |
| 3,838,713 | 10/1974 | Tubbs | 138/121 |
| 3,847,184 | 11/1974 | God | 138/121 |
| 3,858,615 | 1/1975 | Weigl | 138/121 |
| 4,360,104 | 11/1982 | Lang | 138/121 |

FOREIGN PATENT DOCUMENTS

| | | | |
|---|---|---|---|
| 0044059 | 4/1977 | Japan | 15/360 |

*Primary Examiner*—Chris K. Moore

*Attorney, Agent, or Firm*—Walter Ottesen

[57] ABSTRACT

A vacuum cleaner nozzle arrangement has a nozzle defining a suction channel arranged across the width of the nozzle with suction edges surrounding the channel. The nozzle is connected to a connecting wand via a conduit segment disposed therebetween and a vacuum cleaner can be attached to the connecting wand. The nozzle is suspended from the nozzle housing by means of a so-called parallel crank drive. The nozzle housing is configured to be driven or pushed upon a surface to be cleaned.

2 Claims, 1 Drawing Sheet

VACUUM CLEANER NOZZLE ARRANGEMENT

FIELD OF THE INVENTION

The invention relates to a vacuum cleaner nozzle arrangement which has a suction channel the extends across the width of the nozzle and is surrounded by so-called suction edges. The suction channel is joined to a connecting wand so as to permit the passage of air and a vacuum cleaner can be attached to the connecting wand.

BACKGROUND OF THE INVENTION

Various possibilities are known for reducing the pushing force for vacuum cleaner nozzle arrangements. Thus, published German patent application DE-OS No. 31 00 164 discloses a vacuum cleaner nozzle which is provided with very large air intake channels for the suction edges of the suction channel. On the outside of the suction channels, supporting surfaces are provided with are not charged with a force of reduced pressure. In this way, a flotation of the nozzle of the vacuum cleaner on the textile surface is possible so that the pushing force is reduced.

Further, German Pat. No. 28 46 847 discloses vacuum cleaner nozzle arrangements which include: a connecting piece easily movable by means of wheels; a suction channel; and, an additional intermediate piece located between the suction channel and the connecting piece and articulately connected to both. This is intended to prevent lifting or a slanting of the suction edges of the suction channel.

Such nozzle arrangements must, nevertheless, additionally have angle limiters in the tilting joint between the connecting piece and intermediate piece to prevent a doubling-over of the last member of the articulated chain, namely, the nozzle.

Further, configurations of this kind all exhibit a progressive friction characteristic. This means that the larger the resistance of the carpet, the disproportionately larger is the friction force.

The friction force always develops a moment that is directed towards the carpet. Therefore, the pushing force increases sharply.

SUMMARY OF THE INVENTION

It is an object of the invention to provide a vacuum cleaner nozzle arrangement which has a so-called degressive friction characteristic. It is a further object of the invention to provide such a nozzle arrangement in the form of a simple configuration.

According to a feature of the invention, resilient means are utilized for suspending the nozzle on the housing of the vacuum cleaner arrangement. Advantageous embodiments are obtained through the use of such resilient means comprising individual leaf springs or by means of a boundary wall movable by means of film hinges.

The invention thus affords the principle advantage that a vacuum cleaner nozzle arrangement can be provided which has a degressive friction characteristic. It is thus possible to establish a type of control of the pushing force.

BRIEF DESCRIPTION OF THE DRAWING

The invention will now be described with reference to the drawing wherein.

DESCRIPTION OF THE PREFERRED EMBODIMENTS OF THE INVENTION

Figure 1:
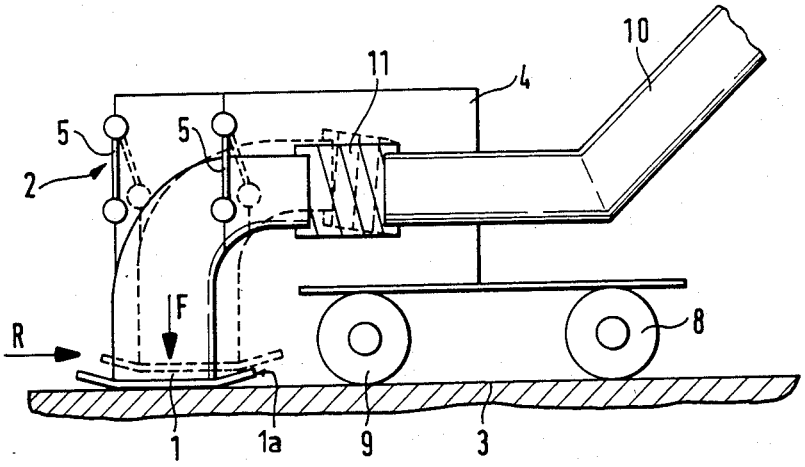
FIG. 1 is schematic of a vacuum cleaner nozzle arrangement wherein the nozzle is suspended on the housing with individual leaf springs; and, FIG. 2 is a vacuum cleaner nozzle arrangement according to another embodiment of the invention wherein the nozzle is suspended and the suction channel is sealed by means of a movable wall.

Referring to FIG. 1, a nozzle housing 4 is provided with wheels 8, 9. A connecting wand 10 is mounted on the housing 4 and is connected to the nozzle 1*a*. This connection includes an elastically movable segment 11. The nozzle 1*a* is suspended from the nozzle housing 4 by means of a so-called parallel crank drive 2 which is here represented by leaf springs 5. If the nozzle housing 4 is now driven to the left in the plane of the drawing and a reduced pressure (partial vacuum) is present in the connecting wand 10, then a force F is exerted on the nozzle in the direction shown by the arrow and a friction force R is developed in the direction of the other arrow.

The nozzle 1*a* will be displaced by the friction force R on the leaf springs 5 into the position shown here by broken lines in a slightly exaggerated manner and thus will be removed from the lower surface 3. In this way, the force F is decreased and a control of the forces required for pushing is obtained. The same is true for the direction of displacement to the right for which the direction of the friction force R and the excursion of the nozzle 1*a* will change in the opposite direction.

Figure 2:
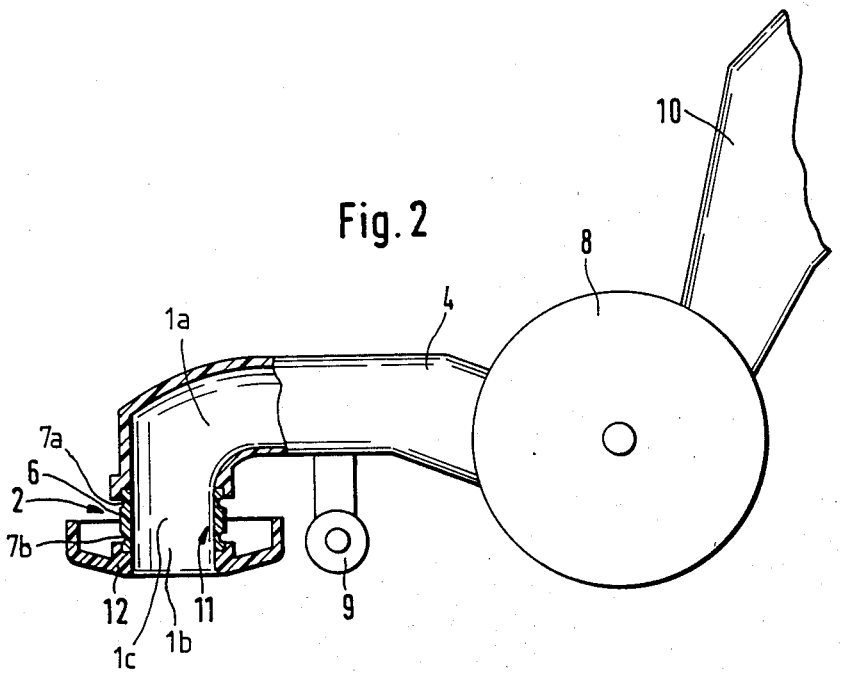

FIG. 2 shows a vacuum cleaner nozzle arrangement according to the invention embodying the concept illustrated with respect to the embodiment of FIG. 1.

The nozzle housing 4 is equipped with a connecting wand 10 and can be driven on wheels 8 and 9.

It is understood that the foregoing description is that of the preferred embodiments of the invention and that various changes and modifications may be made thereto without departing from the spirit and scope of the invention as defined in the appended claims.

What is claimed is:

1. A vacuum cleaner nozzle arrangement for a vacuum cleaner, the nozzle arrangement comprising:

a support movable over the surface to be cleaned;

a rigid conduit member mounted on said support and defining a first suction channel;

a rigid nozzle member;

connecting means for connecting said nozzle member to said rigid conduit member;

said nozzle member having an end face for contact engaging said surface during the cleaning thereof in response to which a reaction force (R) is developed opposing the movement over the surface, said nozzle member defining a second suction channel terminating in said end face in which a partial vacuum causes a downward force (F) to act upon said nozzle member thereby increasing said reaction force (R); and, said connecting means including: a rigid conduit segment interposed between said nozzle member and said conduit member, said conduit segment having first and second longitudinal ends and defining a third suction channel communicating with said first and second suction channels; first hinge means connecting said first longitudinal end to said conduit member so as to permit hinged movement of said conduit segment relative to said conduit member and second hinge means connecting said second longitudinal end to said nozzle member so as to permit hinged movement of said conduit segment relative to said nozzle member; said first and second hinge means and said conduit segment conjointly defining translation means for permitting said nozzle member to undergo a translatory displacement away from the surface to be cleaned in response to said reaction force (R) thereby reducing said partial vacuum and decreasing said downward force (F).

2. The vacuum cleaner nozzle arrangement of claim 1, said first hinge means being a first film hinge for resiliently connecting said first longitudinal end of said conduit segment to said conduit member; and, said second hinge means being a second film hinge for resiliently connecting said second longitudinal end of said conduit segment to said nozzle member.

* * * * *

UNITED STATES PATENT AND TRADEMARK OFFICE

CERTIFICATE OF CORRECTION

PATENT NO. : 4,888,850

DATED : December 26, 1989

INVENTOR(S) : Ludger Helmes and Paul Lienenlüke

It is certified that error appears in the above-identified patent and that said Letters Patent is hereby corrected as shown below:

In column 1, line 6: delete "the" and substitute -- that -- therefor.

In column 1, line 21: delete "with", first occurrence, and substitute -- which -- therefor.

In column 2, between lines 37 and 38, insert the following paragraphs:

-- In the embodiment of FIG. 2, the elastic connection 11 of the schematic of FIG. 1 is defined by the wall 6 which is a conduit segment attached to the nozzle member 12 and to the nozzle housing 4 by means of two film hinges (7a, 7b). The film hinges (7a, 7b) realize the parallel crank drive 2 of FIG. 1. The nozzle housing 4 is a conduit member which defines a first suction channel 1a. A second suction channel 1b is disposed within the nozzle member 12 which moves as an entire part.

The conduit segment 6 defines a third suction channel 1c communicating with the first and second suction channels (1a, 1b).

The first and second hinges (7a, 7b) conjointly define translation means for permitting nozzle member 12 to undergo a

UNITED STATES PATENT AND TRADEMARK OFFICE

CERTIFICATE OF CORRECTION

PATENT NO. : 4,888,850

DATED : December 26, 1989

INVENTOR(S) : Ludger Helmes and Paul Lienenlüke

It is certified that error appears in the above-identified patent and that said Letters Patent is hereby corrected as shown below:

translatory displacement away from the surface to be cleaned in response to the reaction force (R) thereby reducing the partial vacuum and decreasing the downward force (F). --.

Signed and Sealed this

Sixteenth Day of October, 1990

*Attest:*

HARRY F. MANBECK, JR.

*Attesting Officer*

*Commissioner of Patents and Trademarks*